United States Patent [19]

Olsovsky

[11] Patent Number: 4,858,211

[45] Date of Patent: Aug. 15, 1989

[54] ALARM CLOCK LATCH DEVICE

[76] Inventor: Terry Olsovsky, 12723 SummerMill, Houston, Tex. 77070

[21] Appl. No.: 274,408

[22] Filed: Nov. 21, 1988

[51] Int. Cl.[4] ..... G04B 23/02

[52] U.S. Cl. ..... 368/262

[58] Field of Search ..... 368/72–74, 368/243, 244, 250, 257–262

[56] References Cited

U.S. PATENT DOCUMENTS

| | | | |
|---|---|---|---|
| 3,517,499 | 6/1970 | Keane, Jr. et al. | 368/262 |
| 3,797,223 | 3/1974 | Oliveri | 368/262 |
| 4,208,867 | 6/1980 | Polonsky | 368/262 |
| 4,218,875 | 8/1980 | Rothman | 368/73 |
| 4,246,651 | 1/1981 | Komatsu | 368/73 |
| 4,352,170 | 9/1982 | Jetter | 368/202 |
| 4,426,157 | 1/1984 | Jetter | 368/73 |

*Primary Examiner*—Vit W. Miska

*Attorney, Agent, or Firm*—Leon Gilden

[57] ABSTRACT

An alarm clock latching device for preventing disengagement of an alarm associated with an alarm clock preventing ease of disengagement of the alarm. The latch device includes a bar of a first constant cross-sectional configuration with a reduced medial portion of a second constant constant cross-sectional configuration less than the first cross-sectional configuration to define an elongate "U" shaped recess. An enlarged cylindrical grasping member is integrally secured to each end of the bar for enabling enhanced manipulation of the device by an operator. A plurality of spaced brackets positioned on either side of an on/off alarm switch frictionally engage and maintain the bar in a preselected position, and reciprocating abutment member reciprocatably parallel to reciprocating alarm switch to block reciprocation of the switch when the bar is in a raised position.

8 Claims, 3 Drawing Sheets

ALARM CLOCK LATCH DEVICE

BACKGROUND OF THE INVENTION

1. Field of the Invention

The field of invention relates to alarm clocks, and more particularly pertains to a new and improved alarm clock latch device for use in combination with a switching member for disengaging an actuated alarm of an alarm clock to prevent disengagement of the alarm prior to a full awakening by an operator.

2. Description of the Prior Art

The use of various means to engage and disengage alarm devices associated with alarm clocks is well known in the prior art. As may be appreciated, the devices have essentially included integral alarm systems of a complex and elaborate construction not available for retrofitting of such devices to actuate or disengage an alarm clock alarm. For example, U.S. Pat. No. 3,797,223 to Oliveri sets forth an alarm clock formed with the clock positionable from an operative to an inoperative tilted position of the alarm clock to depress a normally biased plunger extending outwardly of the alarm casing to a position inwardly of the alarm clock casing upon tilting of the alarm clock. The patent is of relative ease of use but of a structure and function remote from that of the instant invention to enable a retrofit device associatable with an existing alarm clock to prevent disengagement of an on/off switch.

U.S. Pat. No. 4,218,875 to Rothman sets forth an alarm clock with a detachable overlying alarm that may be manually thrown to disengage the alarm upon impact with a stationary object. The Rothman patent is of interest relative to a novel alarm organization but as typical of the prior art, is of a relatively complex and cumbersome arrangement relative to the instant invention.

U.S. Pat. No. 4,246,651 to Komatsu sets forth an electronic time piece with an alarm with an external member that may be manipulated to control the duration of alarm. The electronic device as set forth is typical of contemporary electronic circuitry and of a construction of relative complexity to that of the instant invention.

U.S. Pat. No. 4,352,170 to Jetter sets forth an alarm clock latching mechanism operative through a relay and time mechanism requiring an operator to maintain a latching mechanism by contiguous force and prevent alarm actuation.

U.S. Pat. No. 4,426,157 to Jetter which may be activated by means of a local or remote manual depressible push button switch which must be held in a depressed condition for a predetermined period of time in order to effectively deactivate the clock alarm. The Jetter patent is again requiring an extensive electronic and built-in circuitry in cooperation with the alarm clock and may be appreciated if of a construction remote to that of the instant invention.

As such, it may be appreciated that there is a continuing need for a new and improved alarm clock latching device which includes the characteristics of ease of use and of installation as well as effectiveness, and in this respect the present invention substantially fulfills that need.

SUMMARY OF THE INVENTION

In view of the foregoing disadvantages inherent in the known types of alarm clock devices now present in the prior art, the present invention provides an alarm clock latch device wherein the same may be effectively and readily retrofitted to an alarm clock employing a reciprocatable lever to effect an on/off actuation of the alarm clock to inhibit disengagement of an activated alarm by a user to require an individual to completely arise from slumber to effect disengagement of the switch. As such, the general purpose of the present invention, which will be described subsequently in greater detail, is to provide a new and improved alarm clock latch device which has all the advantages of the prior art alarm clock devices and none of the disadvantages.

To attain this, the present invention comprises an elongate symmetrical parallelepiped bar of a first square cross-sectional configuration with a medial length of said rod formed with a recess to thin the rod to a rectangular cross-sectional configuration to accept a reciprocatable stepped abutment member to block rearward reciprocation of an alarm clock switch wherein a plurality of spaced brackets laminated with a plastic-like friction surface therein maintain the bar at a pre-designated orientation relative to the abutment member and alarm clock to maintain the rod in a first lowered position to inhibit manual disengagement of the alarm. Each end of the rod is formed with a bulbous end for enhanced manual grasping of the rod to manipulate said rod in a first lowered or a second raised position relative to the alarm switch and alarm clock.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved alarm clock latch device which has all the advantages of the prior art alarm clock devices and none of the disadvantages.

It is another object of the present invention to provide a new and improved alarm clock latch device which may be easily and efficiently manufactured and marketed.

It is a further object of the present invention to provide a new and improved alarm clock latch device which is of a durable and reliable construction.

An even further object of the present invention is to provide a new and improved alarm clock latch device which is susceptible of a low cost of manufacture with regard to both materials and labor, and which accordingly is then susceptible of low prices of sale to the consuming public, thereby making such alarm clock latch devices economically available to the buying public.

Still yet another object of the present invention is to provide a new and improved alarm clock latch device which provides in the apparatuses and methods of the prior art some of the advantages thereof, while simultaneously overcoming some of the disadvantages normally associated therewith.

Still another object of the present invention is to provide a new and improved alarm clock latch device wherein an elongate bar formed with a "U" shaped recess is securable to an alarm clock proximate a reciprocatable alarm clock switch wherein frictional material within securement brackets of the device positions the bar with an abutment member proximate the switch to inhibit premature disengagement of an alarm clock and require a user to totally arise from slumber.

These together with other objects of the invention, along with the various features of novelty whch characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
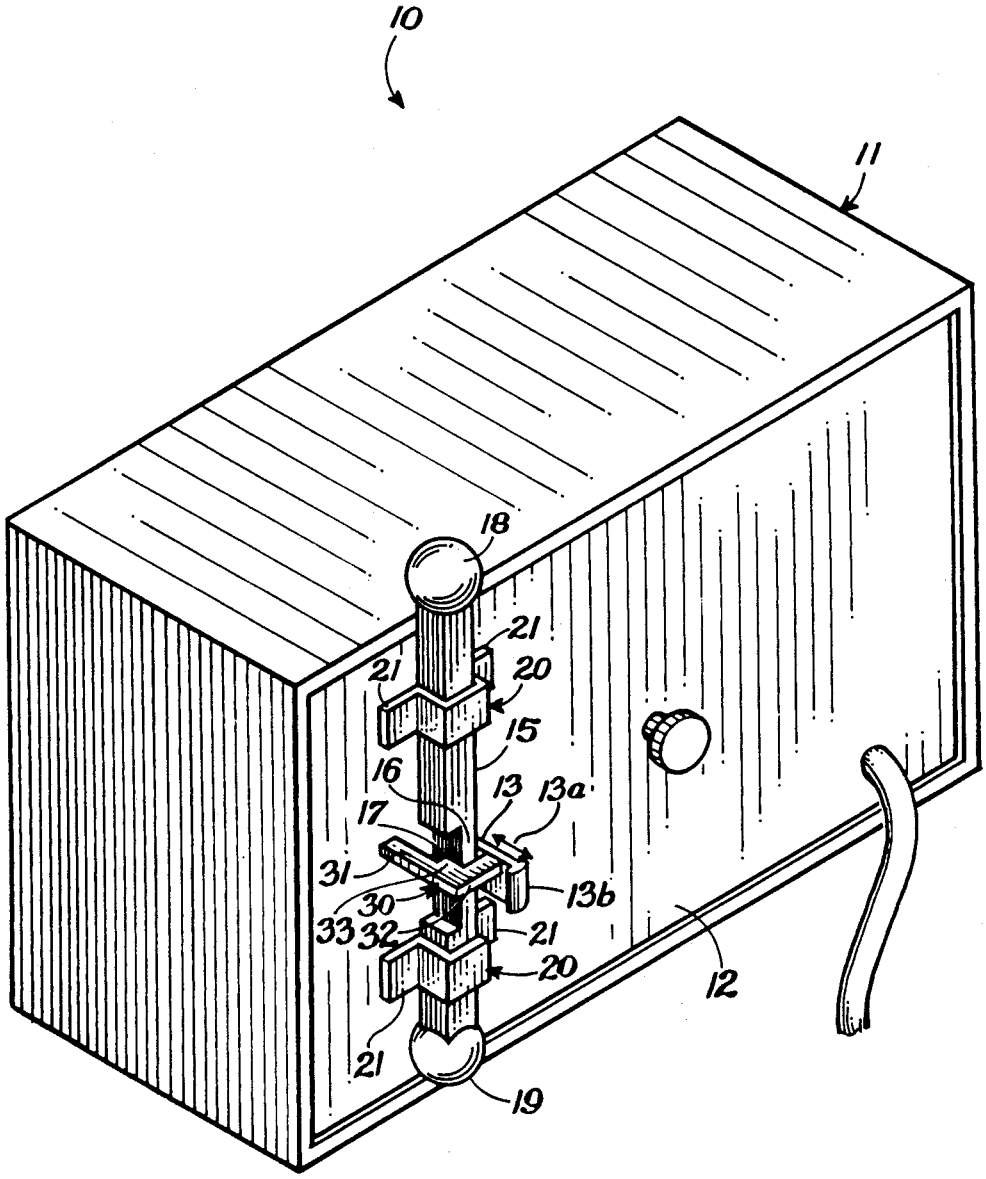
FIG. 1 is an isometric view of the instant invention.
Figure 2:
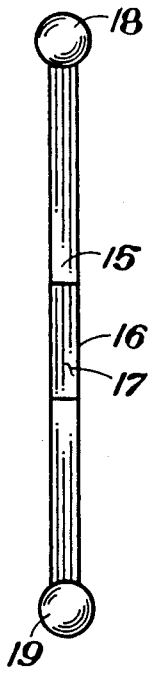
FIG. 2 is a front orthographic view taken in elevation of the control rod of the instant invention.
Figure 3:
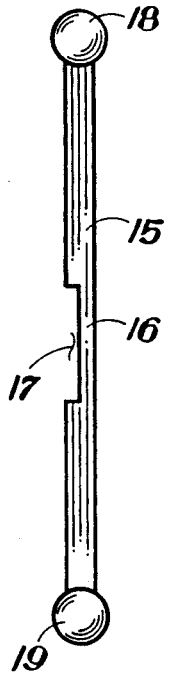
FIG. 3 is a side orthographic view taken in elevation of the control rod of the instant invention.

With reference now to the drawings, and in particular to FIG. 1 thereof, a new and improved alarm clock latch device embodying the principles and concepts of the present invention and generally designated by the reference numeral 10 will be described.

More specifically, it will be noted that the alarm clock latch device 10 essentially comprises a conventional alarm clock 11 formed with a rear face 12 and including a typical reciprocatable slide switch 13 that is movable from a first retracted position, as indicated by the arrow 13*a* and as illustrated in FIG. 1, to a second extended position to respectively disengage and engage the alarm associated with the alarm clock 11. The switch 13 is formed with an enlarged head portion 13*b*, illustrated in the extended position relative to alarm clock 11 wherein the associated audible alarm is in an "on" mode.

To maintain the "on" mode of the alarm clock 11, a control bar 15 of an elongate parallelepiped cross-sectional configuration is oriented in a direction orthogonal to the reciprocative positioning of the switch 13. Typically the cross-sectional configuration of control bar 15 is a square formed with a medial cross-sectional narrowed portion 16 with a generally rectangular cross-sectional configuration defining an elongate "U" shaped recess 17 accepting reciprocation of an abutment member 30.

Figure 6:
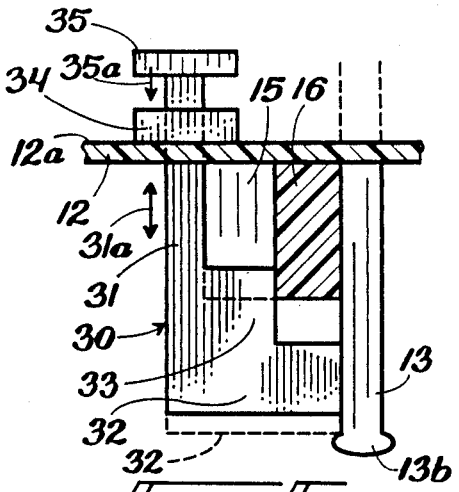
FIG. 6 is a top orthographic view taken in section illustrating the abutment member and grasp bar cooperating with an alarm clock switch.
Figure 7:
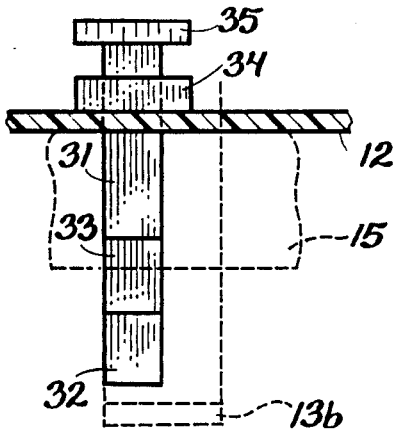
FIG. 7 is a side orthographic view of the illustration of FIG. 6 with the alarm clock switch in phantom for clarity of illustration.
Figure 8:
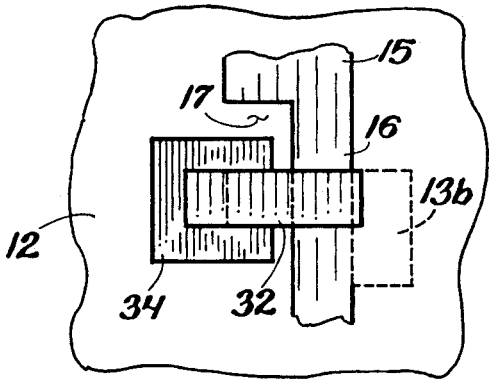
FIG. 8 is a front elevational orthographic view of the abutment bar, grasp bar and alarm clock switch with the alarm clock switch illustrated in phantom.
Figure 9:
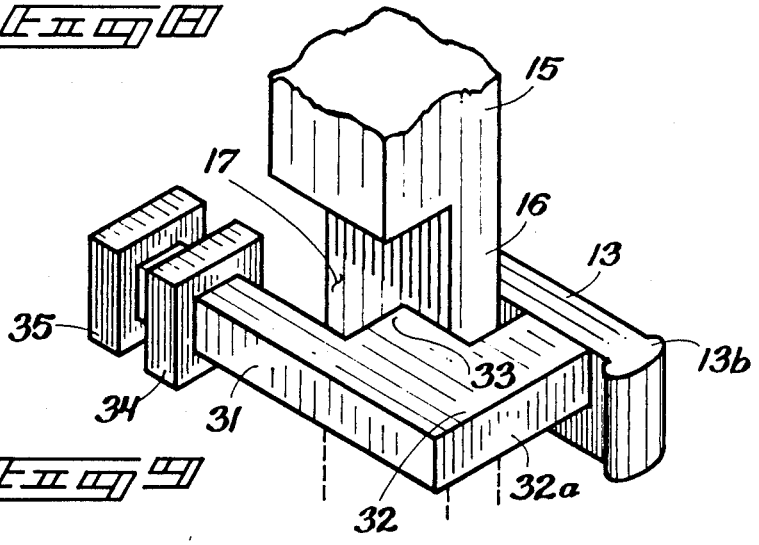
FIG. 9 is an isometric illustration partially in section of the abutment member, grasp bar, and alarm clock switch.

The abutment member 30 is mounted to a first side of the control bar 15 in confronting relationship to the "U" shaped recess 17. The abutment member 30 includes a first elongate leg 31 and a shorter second "L" shaped leg 32 orthogonally oriented relative to the first leg 31. A projecting step portion 31 is formed at the interior portion of the intersection of the first and second legs 32. Integrally mounted to a terminal end of first leg 31 and interiorly of the alarm clock 11 within the rear face 12 is a stop member 35. A guide bushing 34 is integrally mounted to a rear surface 12*a* of the rear face 12 and guidingly and slidingly accepts the first leg 31 therethrough and maintains same in an orthogonal relationship relative to the rear face 12. The stop member 35, upon forward motion in the direction of arrow 35, will abut a rear surface of the guide bushing 34 and limit forward motion of the abutment member 30. A forward face 32*a* of the second leg 32 will thereby engage the enlarged end 13*b* of the switch 13. Forcing the control bar 15 downwardly when the abutment member 30 is in a forward or extended position, as indicated in phantom in FIG. 6, enables the control bar 15 to be manually forced downwardly wherein the "U" shaped 17 is forced past the abutment member 30 and the square cross-sectional portion of the control bar 15 is positioned in confronting and contiguous relationship to the step portion 33 and first leg 31. In this manner, the switch 13 may not be retracted within the alarm clock 11 and therefore an associated audible alarm of the alarm clock 11 may not be switched off forcing an individual to completely arise from slumber to draw the control 15 upwardly and thereby expose "U" shaped recess 17 to the abutment member 30 and enable abutment member 30 to be retracted, as illustrated in FIG. 6, whereupon the switch 13 may thereupon be retracted.

To enhance manual manipulation and positioning of control bar 15, a first top enlarged bulbous end 18 and a second bottom enlarged bulbous end 19 are formed at either terminal end of the control bar 15.

Figure 4:
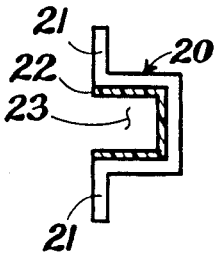
FIG. 4 is a top orthographic view of one of the plurality of brackets utilized by the instant invention.
Figure 5:
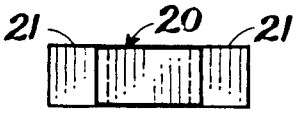
FIG. 5 is a rear orthographic view of the bracket as illustrated in FIG. 4.

A plurality of "U" shaped brackets 20 are secured by conventional fastening or adhesive means to the rear surface 12 of the alarm clock 11 to maintain the control bar 15 in a preselected orientation. Attention to FIG. 4, for example, illustrates the "U" shaped bracket 20 formed with a plurality of orthogonally directed securement legs 21 for attachment to the rear face 12. Laminated interiorly of the "U" shaped bracket 20 is a plastic-like "U" shaped friction surface 22 formed therein to provide a frictional grasping means to maintain the control rod 15 in a preselected orientation as described above. The remaining interior defined space 23 is of a dimension complementary to that of the control rod square cross-sectional configuration 15.

Accordingly, the manner and usage of the instant invention should be apparent from the above description whereby no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An alarm clock latch device in combination with an alarm clock wherein said alarm clock includes an audible alarm and a rear face formed with a reciprocating on/off alarm switch reciprocatable from an extended position to a retracted position relative to said rear face, and mounted orthogonally to said rear face in a first direction, said latch device comprising an elongate control bar means including an elongate recess adjacent said switch wherein said elongate control bar means is mounted for reciprocating motion in a second direction orthogonally to said first direction of said switch, and bracket means for slidingly securing said elongate control rod means to said face including a friction surface for mantaining said control rod means in a predetermined position relative to said switch, and an abutment means reciprocatably mounted to said rear face adjacent said control rod aligned with and spaced from said switch.

2. An alarm clock latch device as set forth in claim 1 wherein said abutment means is reciprocatably mounted within said elongate recess when said elongate control bar is in a raised first position, and said abutment means is prevented from retraction within said rear face when said elongate control bar means is in a lowered second position.

3. An alarm clock latch device as set forth in claim 2 wherein said abutment means is of a generally "L" shaped configuration including a first elongate leg slidably mounted within said rear face, and a second leg orthogonally and integrally secured to said first leg with a stop portion positioned interiorly of said first and second leg in confronting relationship to said control bar means.

4. An alarm clock latch device as set forth in claim 3 wherein said switch includes an enlarged head and said second leg is engageable with an enlarged head when said abutment means is an extended position to prevent retraction of said switch, and said second leg is rearwardly retracted from said enlarged head to enable retraction of said switch when said abutment means is in a retracted position.

5. An alarm clock latch device as set forth in claim 4 wherein said first leg is slidably guided by a bushing integrally secured to an interior surface of said rear face and said rear leg is formed with a terminal stop member to limit extension of said abutment means in the extended position.

6. An alarm clock latch device as set forth in claim 5 wherein said elongate control rod means is formed as an elongate parallelepiped of a first square cross-sectional configuration with a narrow second portion medially formed within said parallelepiped portion defining said recess wherein said elongate recess is configured as a "U" shaped recess within said control rod means.

7. An alarm clock latch device as set forth in claim 6 wherein said bracket means comprises a plurality of "U" shaped brackets formed with orthogonally depending securement legs directed outwardly of said "U" shaped bracket for securement to said rear face wherein said friction surface formed within each of said brackets is a plastic-like material of a relatively high co-efficient of friction relative to said control rod means.

8. An alarm clock latch device as set forth in claim 7 wherein said control rod means is formed with an enlarged bulbous end at each end of said control rod means for enhanced manual grasping and manipulation of said control rod means.

* * * * *